US008434201B2

(12) United States Patent
Wang

(10) Patent No.: US 8,434,201 B2
(45) Date of Patent: May 7, 2013

(54) MAGNETIC FASTENER

(76) Inventor: Kueisheng Wang, Hong Kong (CN)

( * ) Notice: Subject to any disclaimer, the term of this patent is extended or adjusted under 35 U.S.C. 154(b) by 0 days.

(21) Appl. No.: 12/937,461

(22) PCT Filed: Oct. 21, 2009

(86) PCT No.: PCT/CN2009/074540

§ 371 (c)(1),
(2), (4) Date: Oct. 12, 2010

(87) PCT Pub. No.: WO2010/060325

PCT Pub. Date: Jun. 3, 2010

(65) Prior Publication Data

US 2011/0214260 A1 Sep. 8, 2011

(30) Foreign Application Priority Data

Nov. 28, 2008 (CN) ..... 2008 1 0217721
Jul. 31, 2009 (CN) ..... 2009 2 0134449 U

(51) Int. Cl.
*A44C 5/18* (2006.01)

(52) U.S. Cl.
USPC ..... 24/303; 292/251.5; 24/602; 24/537

(58) Field of Classification Search ..... 24/303, 24/602, 578.13, 537, 573.11, 645, 603; 292/251.5, 292/137; 335/306, 207; 70/276; 403/315, 403/316, 317, DIG. 1
See application file for complete search history.

(56) References Cited

U.S. PATENT DOCUMENTS

| | | | | |
|---|---|---|---|---|
| 3,413,692 | A * | 12/1968 | Pressley | 24/602 |
| 3,437,370 | A * | 4/1969 | Thompson et al. | 294/82.29 |
| 5,600,977 | A * | 2/1997 | Piron | 70/57.1 |
| 5,957,313 | A * | 9/1999 | Bouan | 215/215 |
| 6,182,336 | B1 * | 2/2001 | Bauer | 24/303 |
| 2007/0134061 | A1 * | 6/2007 | Nance | 403/362 |
| 2012/0131967 | A1 * | 5/2012 | Sanchez Giraldez | 70/276 |

* cited by examiner

*Primary Examiner* — Robert J Sandy
*Assistant Examiner* — Michael Lee
(74) *Attorney, Agent, or Firm* — Jackson IPG PLLC

(57) ABSTRACT

A magnetic fastener includes first and second lock bodies engaged with each other. The first lock body includes a first magnet and a fastener body. The first magnet is defined with a through hole extending through the two opposite end surfaces of the first magnet. The fastener body is movably received in the through hole. The fastener body includes a main body, an interface part disposed at one end of the main body, and a plurality of elastic arms extending outward from the other end of the main body. The interface part passes through the through hole. A receiving space is defined between the elastic arms. The inner side of the free end of the elastic arms is respectively provided with a clasp. The second lock body includes a second magnet and a hook body connected to the second magnet. The hook body is provided with a buckling part.

10 Claims, 12 Drawing Sheets

MAGNETIC FASTENER

FIELD OF THE INVENTION

The present invention relates to a connection device, and particularly relates to a magnetic fastener.

BACKGROUND OF THE INVENTION

A connection device which is used to connect two objects or to connect two ends of one object, is widely used in all kinds of products. According to the different requirement of different kinds of products, connection devices are configured with different structures or connection methods. For example, a connection device for connecting two ends of a necklace includes a closed ring and a movable retaining ring. By opening the movable retaining ring to connect it with the closed ring, the two ends of the necklace can be connected to wear. By opening the movable retaining ring to separate it from the closed ring, the two ends of the necklace are disconnected for facilitating to store. This kind of connection device has a comparatively simplistic structure and so is inconvenient to use. Furthermore, this kind of connection device is easily deformed after being used for many times, which adversely affects the connection performance.

However, with the improvement of living standards of people, the requirement to a connection device is gradually increased. The connection device is not only required to meet the requirement of general function, but also required to be more convenient, firmer, more durable and more funny to use and to be suitable for more people in different environments. So, the conventional connection device is required to be improved or it is required to provide some new connection devices.

SUMMARY OF THE INVENTION

An object of the present invention is to provide a magnetic fastener, which employs first and second magnets to attract each other for connecting first and second lock bodies, thereby facilitating to use, connecting more reliably, being uneasy to break and being durable.

Another object of the present invention is to provide a magnetic fastener, which disconnect first and second magnets to separate first and second lock bodies, thereby being convenient to use and being durable.

To achieve the above mentioned objects, the present invention provides a magnetic fastener comprising first and second lock bodies engaged with each other. The first lock body includes a first magnet and a fastener body. The first magnet is defined with a through hole extending through the two opposite end surfaces of the first magnet. The fastener body is movably received in the through hole. The fastener body includes a main body, an interface part disposed at one end of the main body, and a plurality of elastic arms extending outward from the other end of the main body. The interface part passes through the through hole. A receiving space is defined between the elastic arms. The inner side of the free end of the elastic arms is respectively provided with a clasp. The second lock body includes a second magnet and a hook body connected to the second magnet. The hook body is provided with a buckling part. The elastic arms of the fastener body is elastically deformed by inserting the buckling part into the receiving space of the fastener body as well as by the magnetic poles of the opposite two end surfaces of the first magnet and the second magnet attracting and abutting each other, whereby the clasps buckles with the buckling part for locking the first lock body and the second lock body together.

The interface part and the main body are integrally formed; the interface part passes through the through hole, and the interface part is a connection hole defined at the end of the main body or is a butt component disposed at the end of the main body; or, the interface part is provided with an adjusting part that projects from the side surface of the main body along the radial direction of the main body, the interface part and the adjusting part are made of materials that is attractable by a magnet.

The interface part and the main body are formed separatedly; the interface part comprises a hook part, a block part, and a connection part connected between the hook part and the block part; the block part and the connection part cooperatively form a T-shape; the hook part is ring-shaped; the main body of the fastener body is provided with a perforation; the block part of the interface part abuts the main body of the fastener body; the hook part abuts the end surface of the first magnet to prevent the interface part from being separated from the through hole.

A collar is received in the through hole of the first magnet, and the collar is provided with a shoulder; protuberances are formed at the outside of the free end of the elastic arms, and the protuberances abut against the side wall of the collar to facilitate the clasps to buckle with the buckling part.

The main body is provided with a locating part; the fastener body also comprises an elastic device that is sleevingly disposed at the main body with one end of the elastic device abutting against the shoulder of the collar, and the other end abutting against the locating part.

The second magnet is defined with a mounting hole which extends through the two opposite end surfaces of the second magnet; the hook body also comprises a neck part connected to the buckling part, a mounting part connected to the neck part, and a butt part connected to the mounting part; the mounting part is received in the mounting hole; the hook body is fixedly connected to the second magnet; the buckling part is wider than the neck part along the radial direction of the neck part; the butt part is ring-shaped.

A moving component is disposed between the interface part and the elastic arms; the moving component is spherical, is received in the receiving space, and is made of materials attractable by a magnet.

An isolating component is disposed between the moving component and the interface part, and is made of materials that are not attracted by a magnet; the isolating component is spherical or cylindrical, and is connected to the interface part or to the moving component, or is not connected to the interface part or the moving component.

The magnetic poles of the end surface of the first magnet opposite to the clasps and the end surface of the second magnet opposite to the buckling part are respectively S pole and N pole, or N pole and S pole; or, the opposite end surfaces of the first magnet and the second magnet are respectively provided with N pole and S pole.

A first shell is covered on the first magnet, and a second shell is covered on the second magnet; or, a third shell is covered on the first magnet with one end of the third shell being defined with an opening that extends outward along the first magnet; the diameter of the opening is a slightly larger than the diameter of the second magnet; when the second magnet is at the locking status, the second magnet is inserted inside the third shell.

The advantages of the present invention are described as follows. The magnetic fastener of the present invention only needs magnetic force to achieve connection, whereby the magnetic fastener is convenient for use, and is locked stably. Moreover, the magnetic fastener of the present invention is easy to be unlocked. That is, it only need overcome the magnetic force between the first magnet and the second magnet to achieve unlocking. Furthermore, this unlocking method will not damage the first lock body and the second lock body, which is good for durability.

The characteristic and the technical solution of the present invention are best understood from the following detailed description with reference to the accompanying figures, but the figures are only for reference and explaining, not to limit the scope of the invention.

DESCRIPTION OF THE PREFERRED EMBODIMENTS

Hereinafter, the present invention is described detailedly with reference to the accompanying figures.

Figure 1:
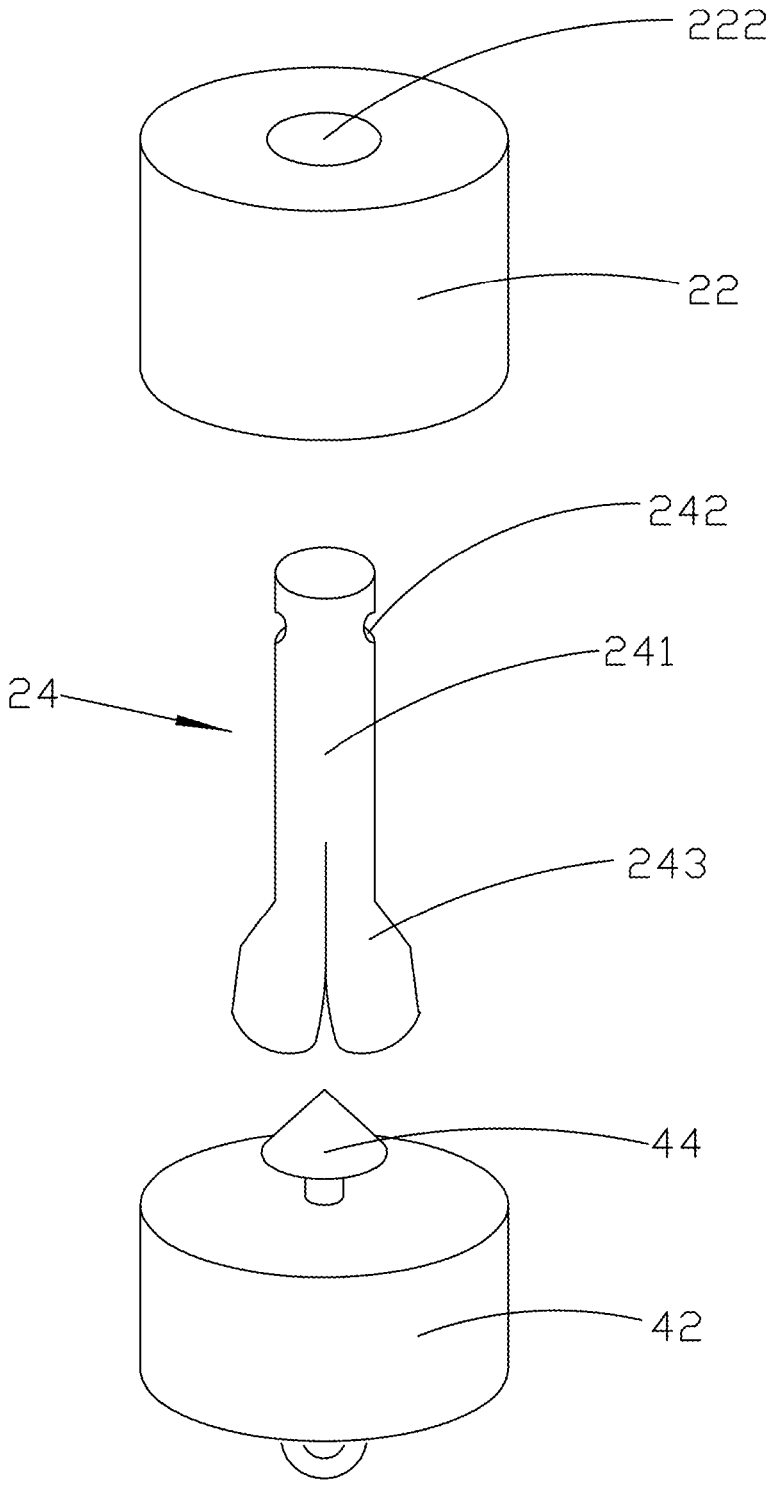
FIG. 1 is an exploded view of a magnetic fastener in accordance with an embodiment of the present invention.
Figure 2:
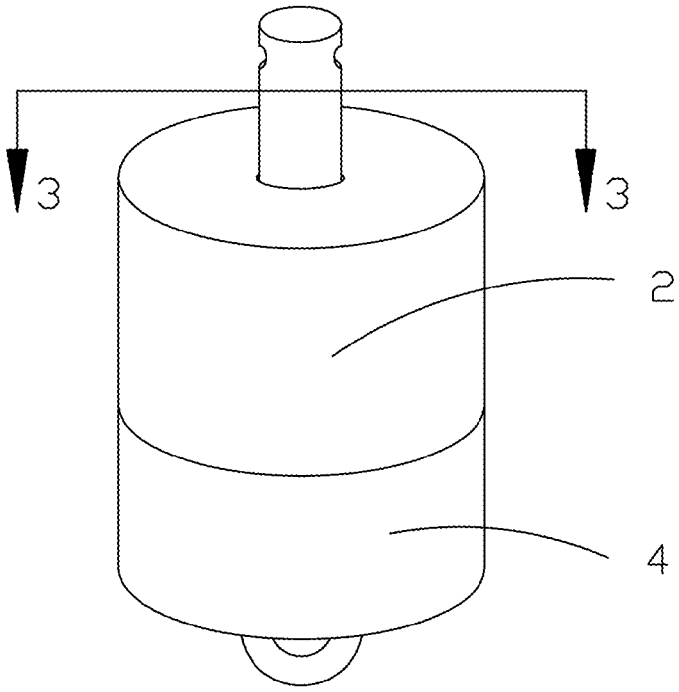
FIG. 2 is an assembled view of FIG. 1.
Figure 3:
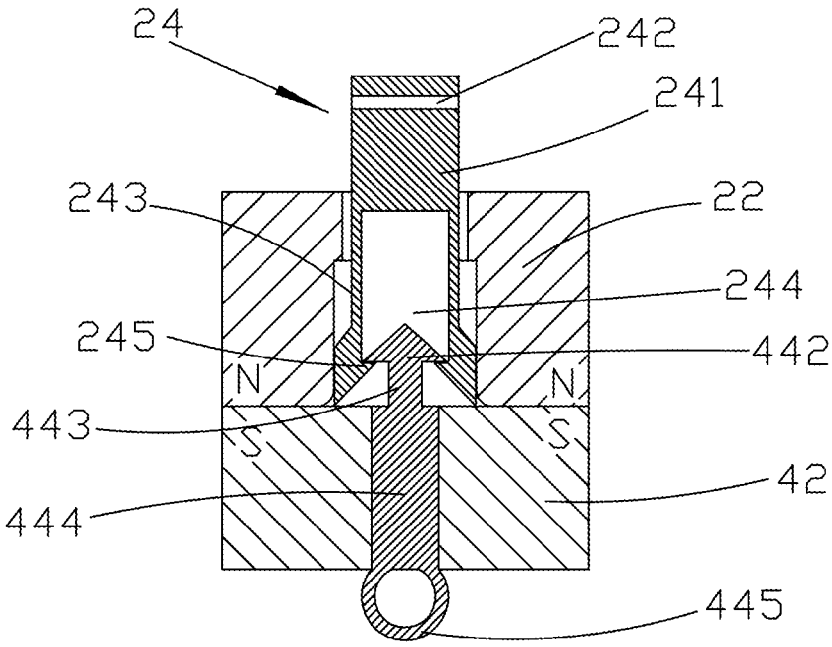
FIG. 3 is a sectional view taken along line 3-3 of FIG. 2, and illustrating the locking status of the magnetic fastener of the present invention.
Figure 4:
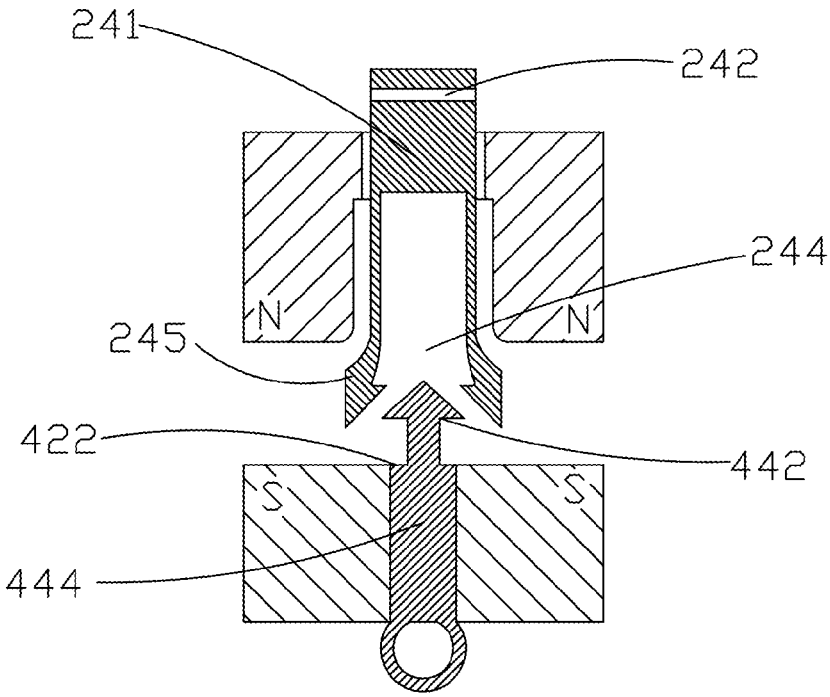
FIG. 4 is a sectional view similar to FIG. 3, illustrating the unlocking status of the magnetic fastener of the present invention.
Figure 9:
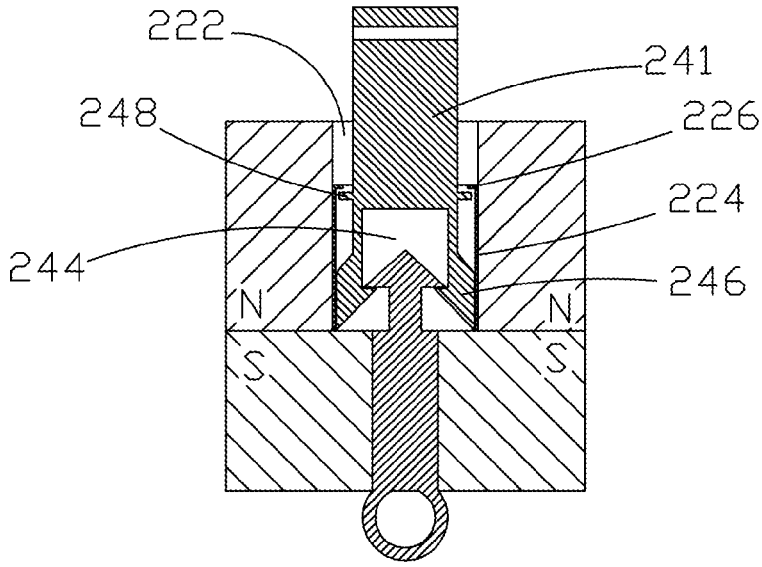
FIG. 9 is a sectional view similar to FIG. 3, illustrating a magnetic fastener in accordance with another embodiment of the present invention.
Figure 10:
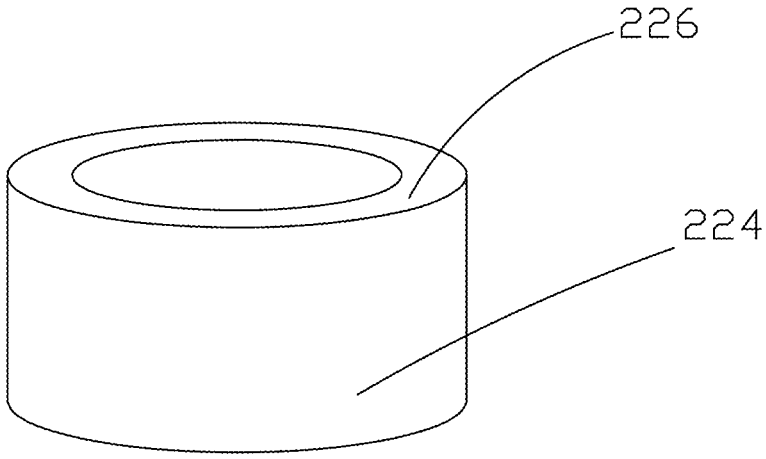
FIG. 10 is a perspective view of a collar of FIG. 9.

Referring to FIGS. 1-4, a magnetic fastener in accordance with a first embodiment of the present invention includes first and second lock bodies 2, 4 which are engaged with each other. The first lock body 2 comprises a first magnet 22 and a fastener body 24. The first magnet 22 is defined with a through hole 222 extending through two opposite end surfaces of the first magnet 22. The through hole 222 may be a stepped through hole (as shown in FIG. 3). The through hole 222 may be a straight through hole (as shown in FIG. 9) with a collar 224 (as shown in FIG. 10) being received therein. The collar 224 is provided with a shoulder 226.

Figure 5:
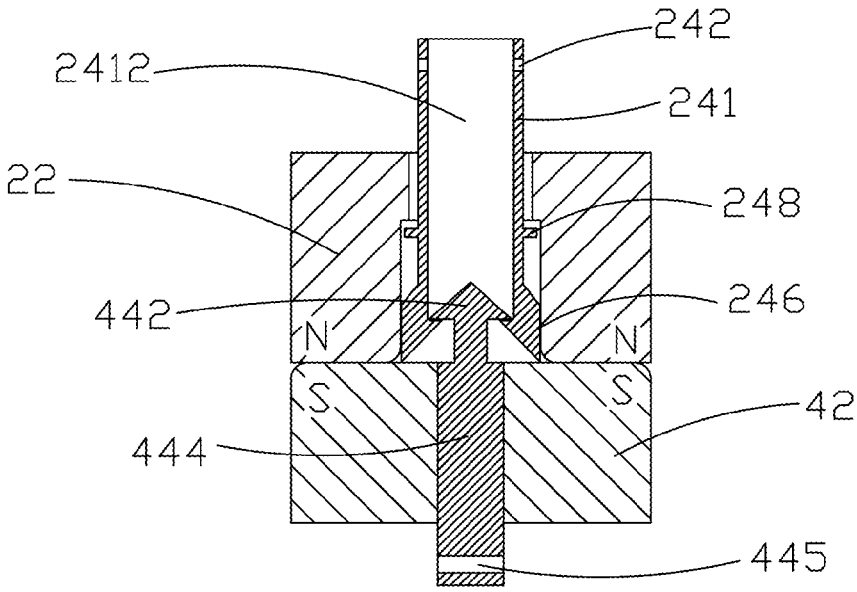
FIGS. 5-8 are sectional views similar to FIG. 3, illustrating alternative embodiments of the magnetic fastener.
Figure 6:
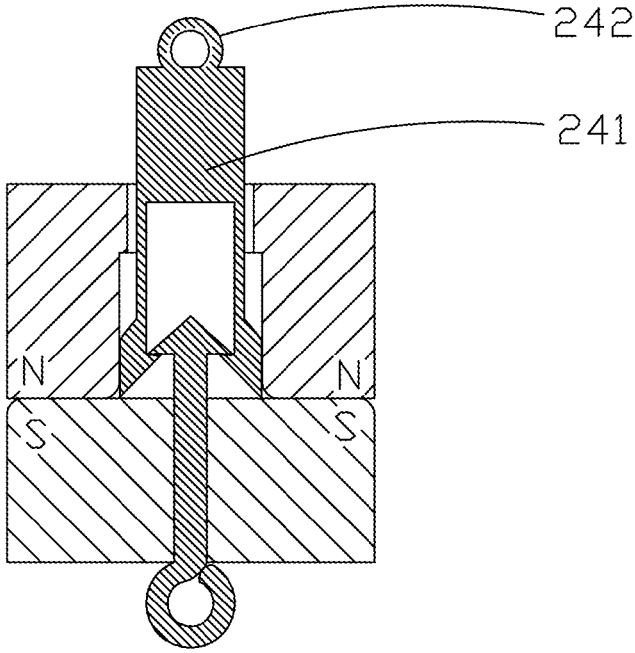
Figure 7:
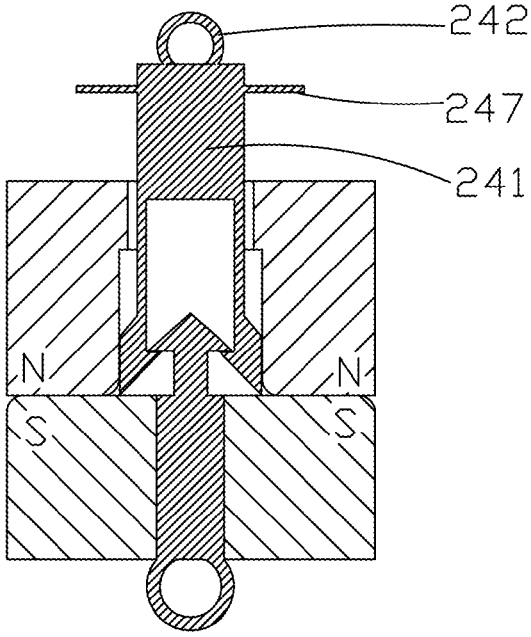

The fastener body 24 comprises a main body 241, an interface part 242 disposed at one end of the main body 241, and a plurality of elastic arms 243 extending outward from the other end of the main body 241. The main body 241 and the interface part 242 of the fastener body 24 can be integrally formed. In this embodiment, the main body 241 is a solid column. In other embodiment, the main body 241 can also be a column with a perforation 2412 defined along the center thereof (as shown in FIG. 5). The fastener body 24 is movably received in the through hole 222, and the interface part 242 passes through the through hole 222. A receiving space 244 is defined between the elastic arms 243. The inner side of the free end of the elastic arms 243 is respectively provided with a clasp 245. In the present invention, the quantity of the elastic arms 243 of the fastener body 24 can be two or more than two. Preferably, the elastic arms 243 are disposed evenly, and are three. In this embodiment, the interface part 242 is a connection hole defined at the end of the main body 241. In another embodiment, the interface part 242 can be a butt component connected to the end of the main body 241 (as shown in FIG. 6). The butt component is made of materials that can be attracted by a magnet. As an optional embodiment, the interface part 242 is also provided with an adjusting part 247 projecting from the side surfaces of the main body 241 along the radial direction of the main body 241. Moreover, the interface part 242 and the adjusting part 247 are made of materials that can be attracted by a magnet (as shown in FIG. 7). When the first lock body and the second lock body are not closed, the interface part 242 and the adjusting part 247 can be attracted by the first magnet 22 to facilitate the elastic arms 243 to expand outward, so as to generate a certain push force to the fastener body 24, thereby unlocking the magnetic fastener easily and conveniently.

The second lock body 4 comprises a second magnet 42 and a hook body 44 connected to the second magnet 42. Preferably, the hook body 44 is fixedly connected to the second magnet 42. The second magnet 42 is defined with a mounting hole 422 extending through the two opposite end surfaces of the second magnet 42. The hook body 44 comprises a buckling part 442, a neck part 443 connected to the buckling part 442, a mounting part 444 connected to the neck part 443, and a butt part 445 connected to the mounting part 444. The mounting part 444 is received in the mounting hole 422. The hook body 44 is fixedly connected to the second magnet 42. The buckling part 442 is wider than the neck part 443 along the radial direction of the neck part 443. The butt part 445 is ring-shaped.

In this embodiment, the magnetic poles of the end surface of the first magnet 22 opposite to the clasps 245 and the end surface of the second magnet 42 opposite to the buckling part 442 are respectively S pole and N pole. For locking the first lock body 2 and the second lock body 4, the clasps 245 of the first lock body 2 and the buckling part 442 of the second lock body 4 are moved along the direction of approaching each other, so as to insert the buckling part 442 into the receiving space 244 of the fastener body 24. Then the magnetic poles of the opposite two end surfaces of the first magnet 22 and the second magnet 42 are attracted to and abut against each other, which enables the elastic arms 243 of the fastener body 24 to be elastically deformed and received in the collar 224 of the first magnet 22. Protuberances 246 respectively formed at the outer side of elastic arms 243 abut against the side wall of the collar 224 to facilitate the clasps 245 to buckle with the buckling part 442. Therefore, the first lock body 2 and the second lock body 4 are locked together. If the buckling part 442 is not well buckled with the clasps 245 when the first magnet 22 and the second magnet 42 attract each other, the elastic arms 243 can be controlled to slightly expand via the adjusting part 247, whereby the buckling part 442 is smoothly inserted into the receiving space 244 to be buckled with the clasps 245. The magnetic fastener of the present invention only needs magnetic force to achieve connection, thereby being convenient for use, and being locked stably.

Similarly, for unlocking the first lock body 2 and the second lock body 4, the first magnet 22 is moved along the main body 241 of the fastener body 24 towards the direction of the interface part 242, to make the clasps 245 of the elastic arms 243 to be out of the through hole 222 of the first magnet 22, thereby unbuckling the clasps 245 from the buckling part 442. Therefore, the first lock body 2 and the second lock body 4 are unlocked. So, the magnetic fastener of the present invention is easy to be unlocked. That is, it only need overcome the magnetic force between the first magnet and the second magnet to achieve unlocking. Furthermore, the first lock body and the second lock body are not damaged though the unlocking manner of the present invention, which is good for durability.

Figure 8:
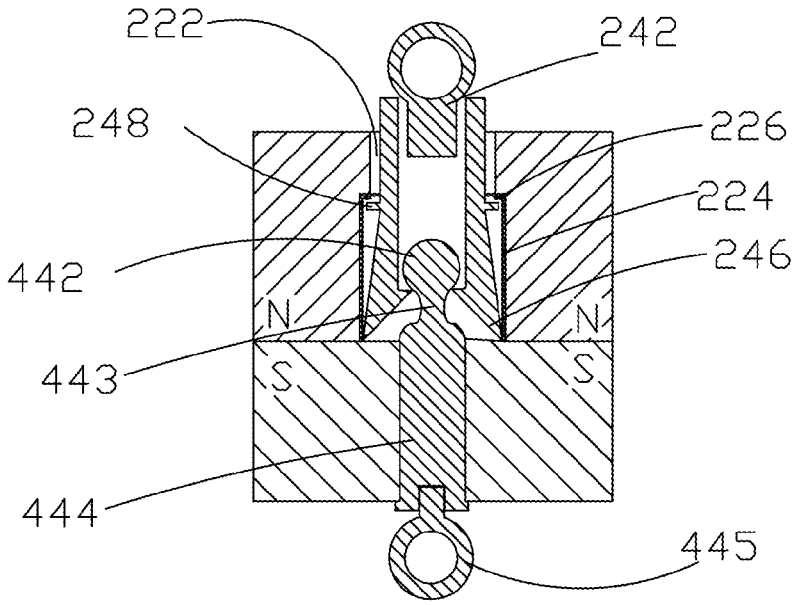
Figure 11:
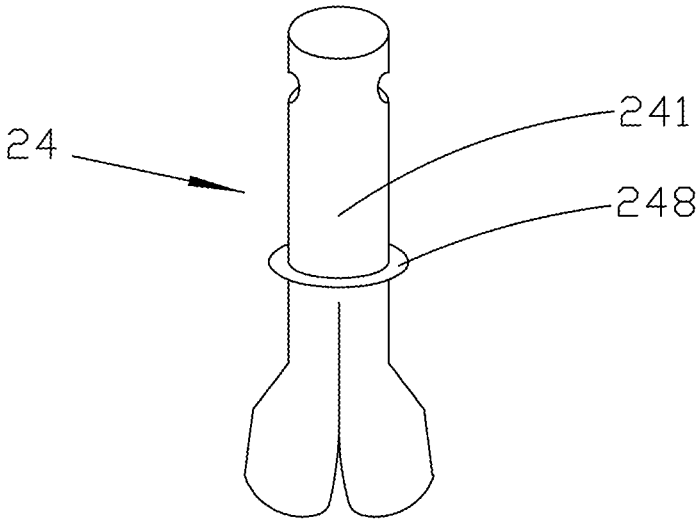
FIG. 11 and FIG. 12 are perspective views of fastener bodies in FIG. 9, illustrating locating parts of the fastener bodies.
Figure 12:
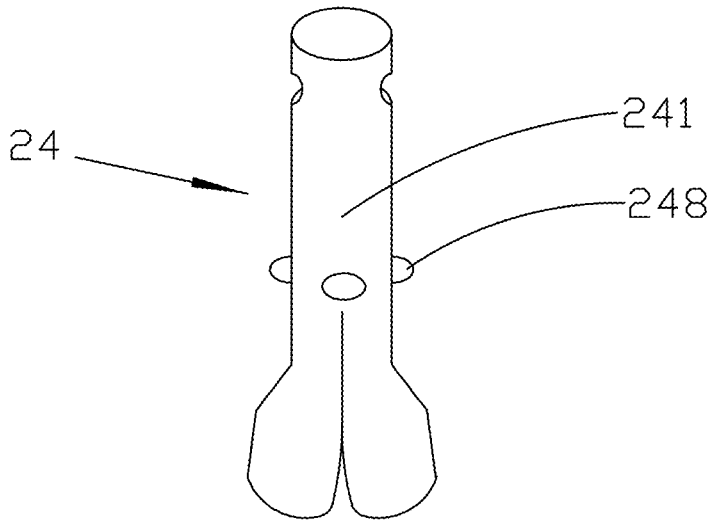

As shown in FIGS. 8-10, as a preferred embodiment of the present invention, protuberances 246 are disposed at the outside of the free end of the elastic arms 243, and the protuberances 246 abut against the side wall of the collar 224 to facilitate the clasps to buckle with the buckling part. The main body is provided with a locating part 248. As an alternative embodiment of the present invention, the locating part 248 can be a ring-shaped rib located at the main body (as shown in FIG. 11). In another embodiment, the locating part 248 can also be a plurality of salient points located at the main body (as shown in FIG. 12).

Figure 13:
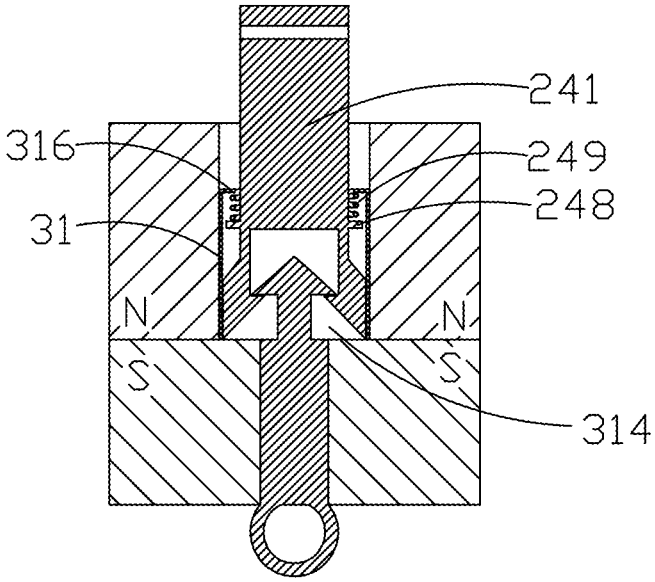
FIG. 13 is a sectional view similar to FIG. 3, illustrating a magnetic fastener in accordance with a further embodiment of the present invention.

As shown in FIG. 13, as another preferred embodiment of the present invention, the fastener body 24 also comprises an elastic device 249. In this embodiment, the elastic device 249 is a spring, which is sleevingly disposed at the main body 241 with one end of the spring abutting against the shoulder 226 of the collar, and the other end thereof abutting against the locating part 248. While unlocking the first lock body and the second lock body, the elastic device 249 can facilitate the elastic arms to expand toward the outside of the through hole, so as to be convenient for the operation of unlocking or next locking.

Figure 14:
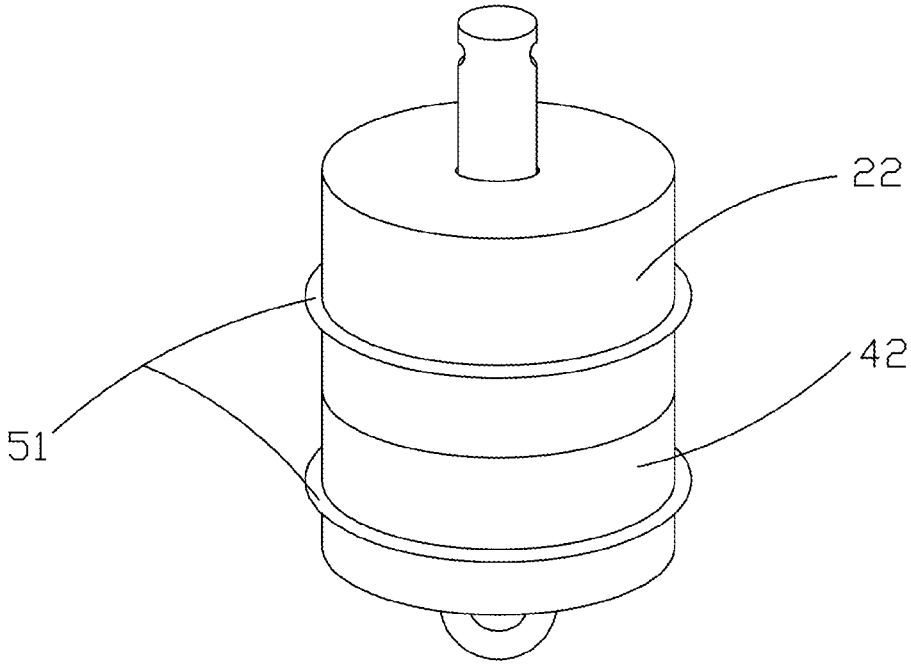
FIG. 14 is a perspective view similar to FIG. 2, illustrating a magnetic fastener in accordance with a further embodiment of the present invention.

As shown in FIG. 14, as a further preferred embodiment of the present invention, the side surfaces of the first magnet 22 and the second magnet 42 are respectively provided with a ring-shaped bulge 51, which can increase the friction force between a hands and the first or second magnet, thereby being convenient for the users to unlock the magnetic fastener. The ring-shaped bulges 51 are fixedly disposed at the first magnet and the second magnet. In other embodiment, the first magnet 22 and the second magnet 42 can be provided with two or more than two ring-shaped bulges, and the ring-shaped bulges can be integrally formed with the first magnet or the second magnet.

Figure 15:
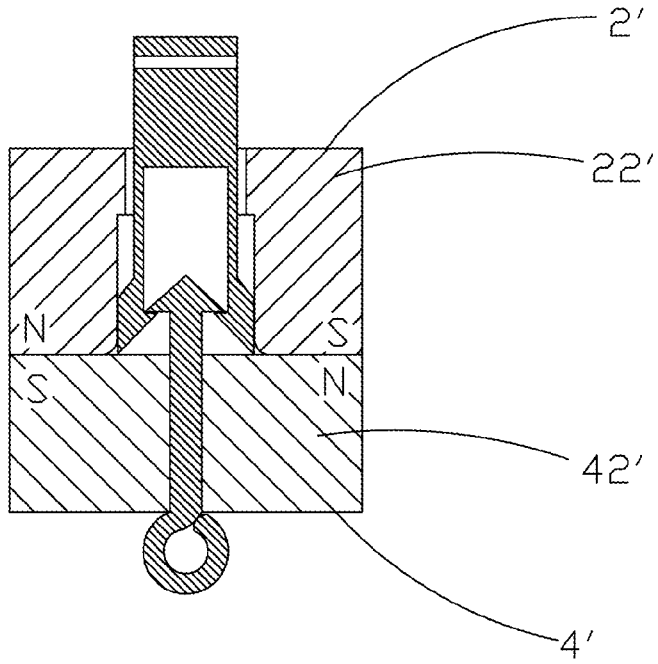
FIG. 15 is a sectional view similar to FIG. 3, illustrating a magnetic fastener in accordance with a further embodiment of the present invention.

Referring to FIG. 15, as a further embodiment of the present invention, the end surfaces of the first magnet 22' and the second magnet 42' facing to each other are respectively provided with N pole and S pole. So, through unlike poles of the magnetic poles of the first magnet and the second magnet attracting each other, the first lock body 2' can be locked to the second lock body 4'. Through like poles of the magnetic poles of the first magnet 22' and the second magnet 42' repelling each other, the first lock body 2' and the second lock body 4' can be unlocked. In operation, by rotating the first magnet 22' or the second magnet 42', the magnetic poles between the first magnet 22' and the second magnet 42' can be made like or unlike. The magnetic fastener of the present invention is easier to operate via the rotating operation.

Figure 16:
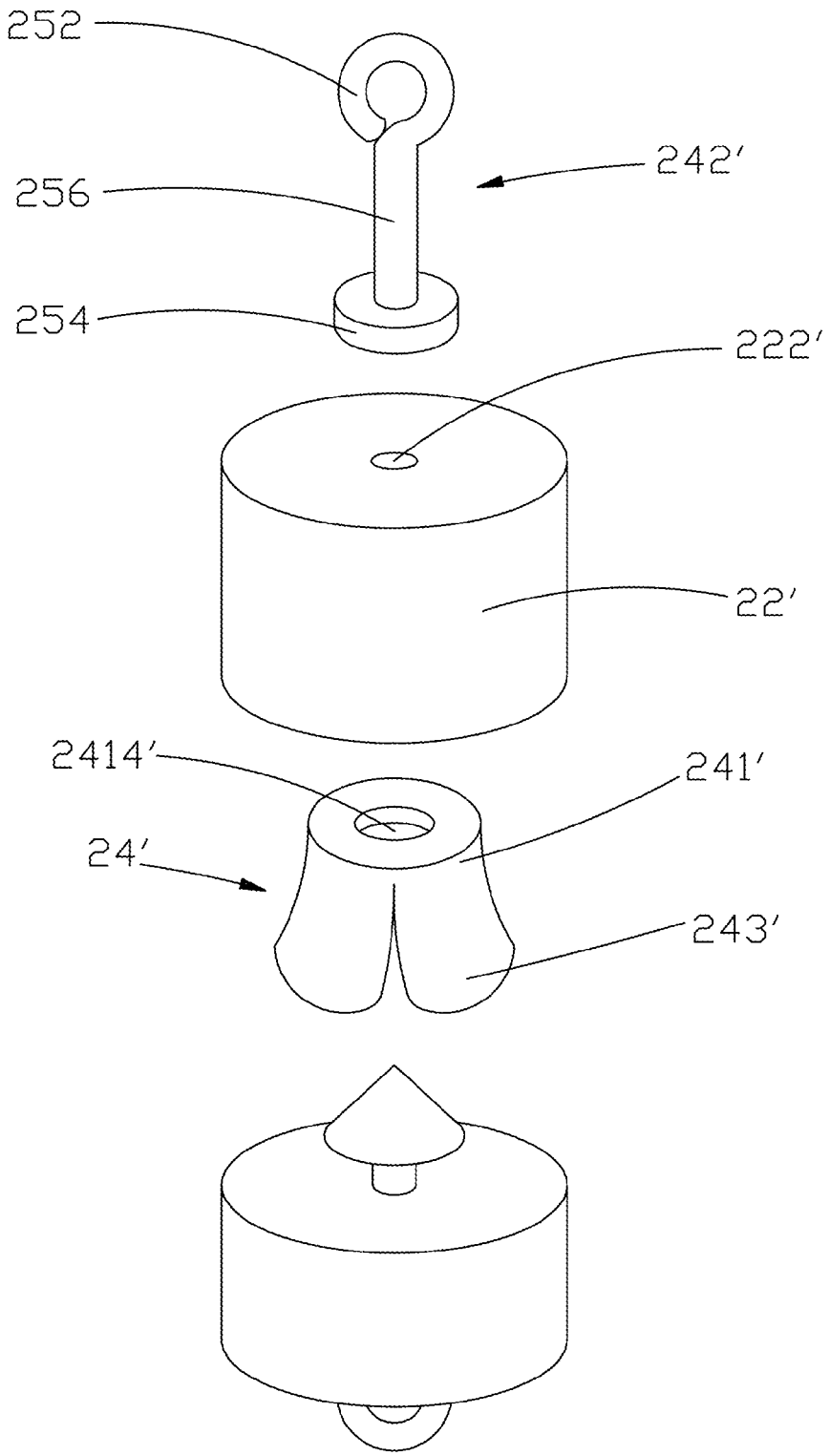
FIG. 16 is an exploded view of a magnetic fastener in accordance with a further embodiment of the present invention.
Figure 17:
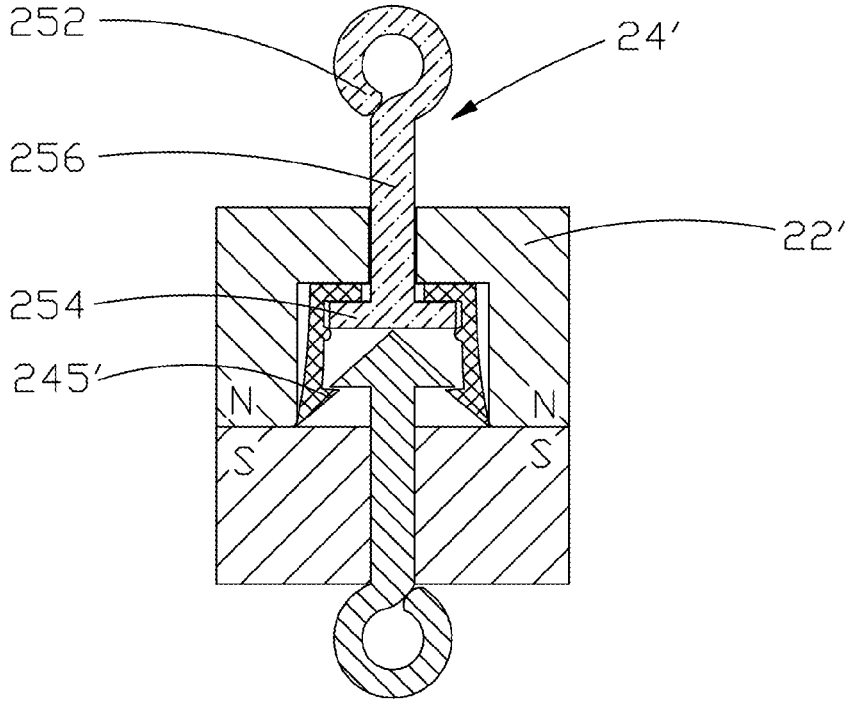
FIG. 17 is a sectional and assembled view of FIG. 16, illustrating the locking status of the magnetic fastener of the present invention.
Figure 18:
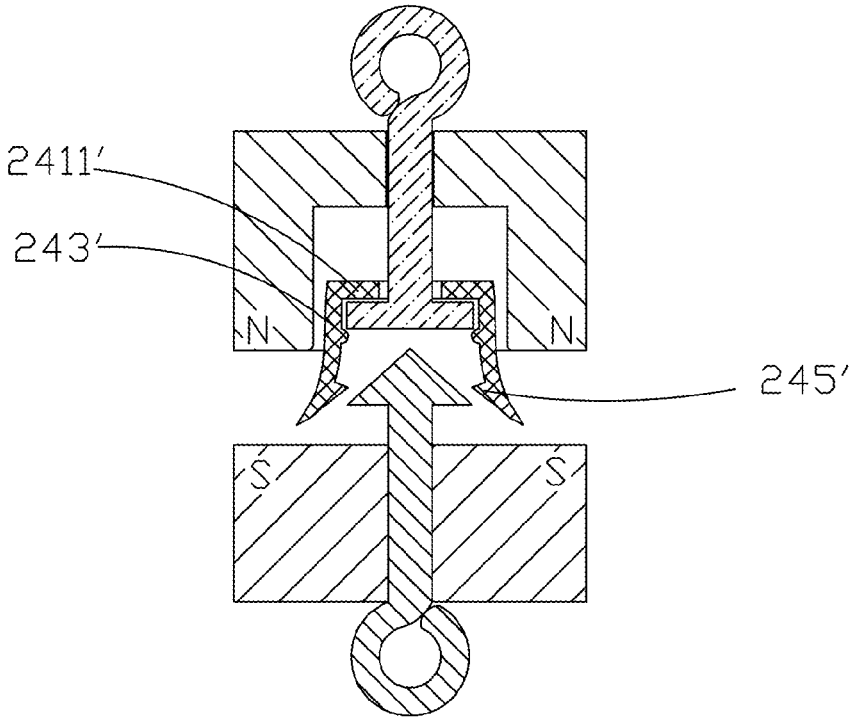
FIG. 18 is a sectional view similar to FIG. 17, illustrating the unlocking status of the magnetic fastener of the present invention.

FIGS. 16-18 show a magnetic fastener in accordance with the third embodiment of the present invention. Comparing with the first embodiment of the present invention, the differences are described as follows. The main body 241' and the interface part 242' of the fastener body 24' are separatedly made. The interface part 242' comprises a hook part 252, a block part 254, and a connection part 256 connected between the hook part 252 and the block part 254. The block part 254 and the connection part 256 cooperatively form a T-shape. The hook part 252 is ring-shaped. The main body 241' of the fastener body 24' is provided with a perforation 2414'. The block part 254 of the interface part 242' abuts the main body 241' of the fastener body 24'. The hook part 252 abuts the end surface of the first magnet 22' to prevent the interface part 242' from being separated from the through hole 222'.

Figure 19:
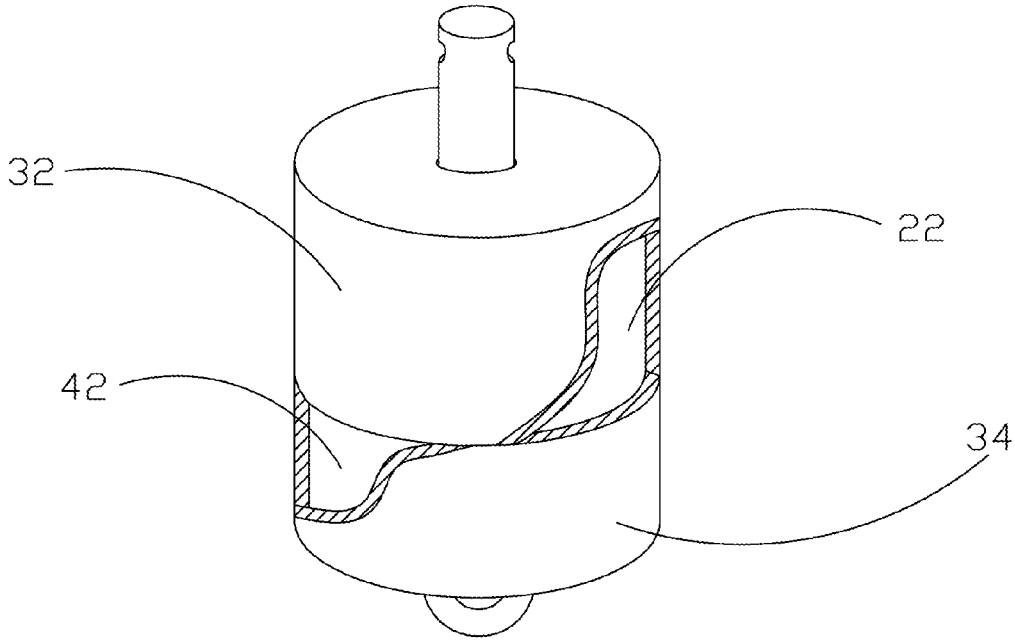
FIG. 19 and FIG. 20 are perspective views of magnetic fasteners in accordance with further embodiments of the present invention.

In this embodiment, in assembly of the first lock body 2', the hook part 252 of the fastener body 24' is not formed firstly to enable the hook part 252 to pass through the perforation 2414' and the through hole 222' of the first magnet 22', and then the ring-shaped hook part 252 is formed. The block part 254 of the interface part 242' abuts against the base part 2411' of the main body 241', and the connection part 256 of the interface part 242' can slide in the perforation 2414'. The hook part 252 can abut against the end surface of the first magnet 22' to prevent the interface part 242' from being separated from the perforation 2414'. Referring to FIG. 19, when the fastener body 24' is at a natural state, the main body 241' and elastic arms 243' are received in the first magnet 22', and the clasps 245' are exposed outside the first magnet 22'. The distance between the opposite clasps 245' is longer than the diameter of the through hole 222'. Referring to FIG. 18, when an external force is applied to the main body 241', the main body 241' can be completely received in the first magnet 22', and the clasps 245' of the elastic arms 243' abut against the side wall of the through hole 222' of the first magnet 22'.

Referring to FIG. 19, as an alternative embodiment of the present invention, a first shell 32 is covered on the first magnet 22 of the present invention, and a second shell 34 is covered on the second magnet 42.

Figure 20:
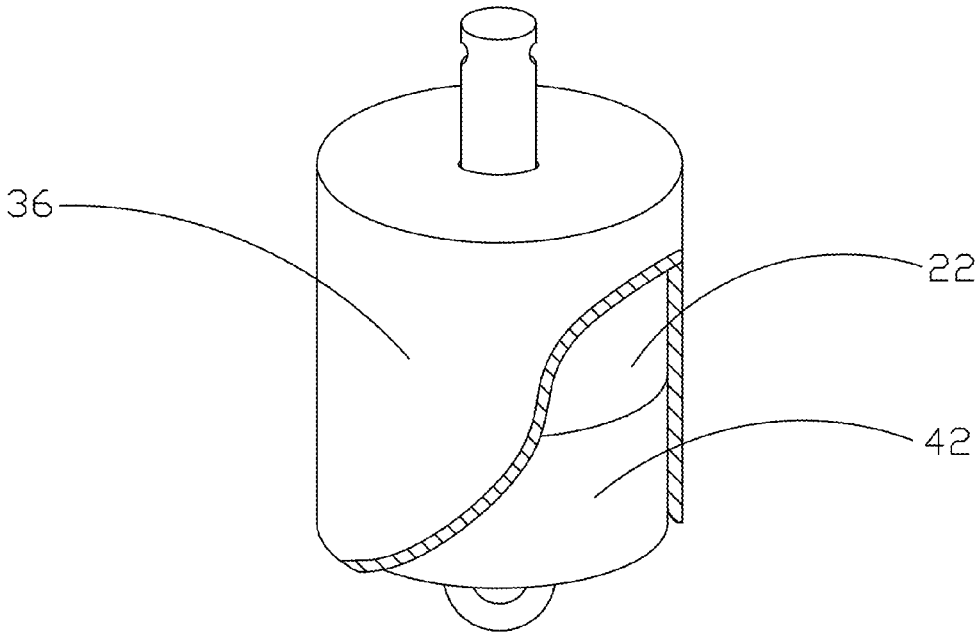

Referring to FIG. 20, as another alternative embodiment, a third shell 36 is covered on the first magnet 22. One end of the third shell 36 is provided with an opening 362 and extends outward along the first magnet 22. The diameter of the opening 362 is a little larger than the diameter of the second magnet 42. When the second magnet 42 is at the locking status, it can be inserted inside the third shell 36.

Figure 21:
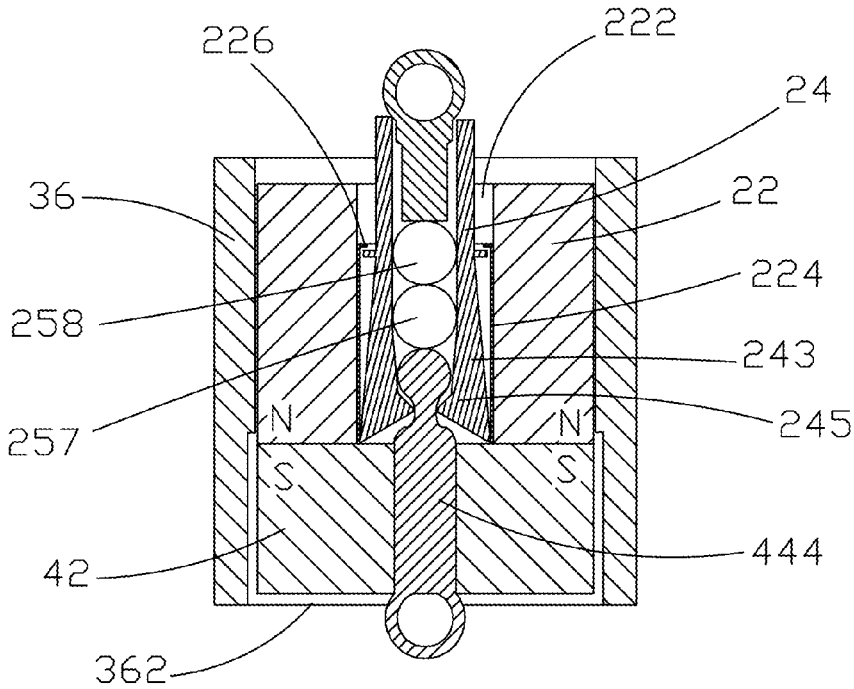
FIG. 21 is a sectional view similar to FIG. 3, illustrating the locking status of the magnetic fastener of the present invention.
Figure 22:
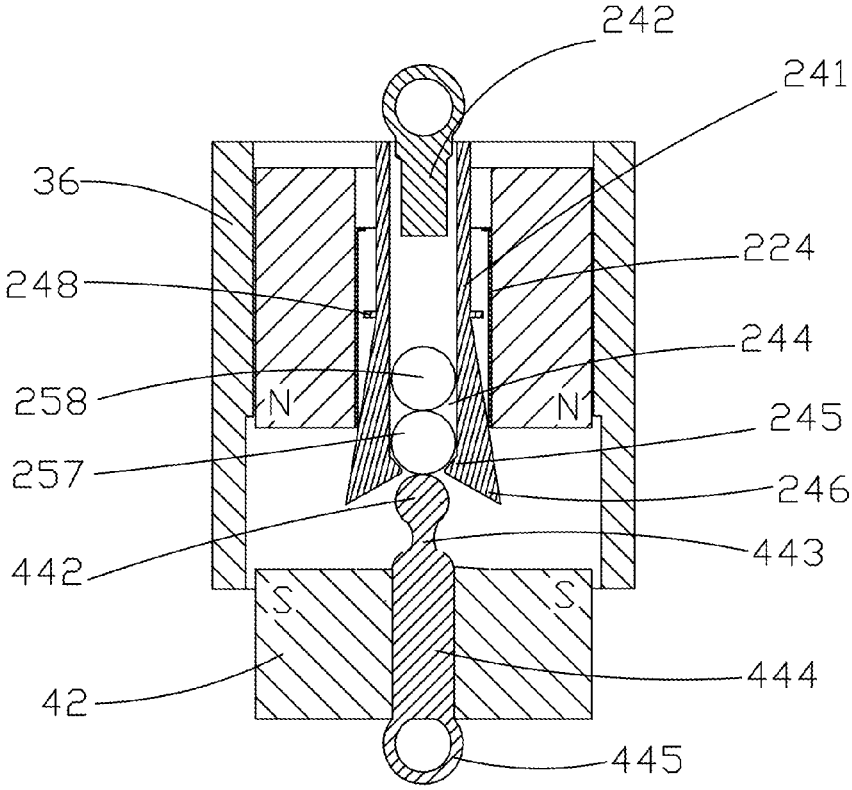
FIG. 22 is a sectional view similar to FIG. 21, illustrating the unlocking status of the magnetic fastener of the present invention.

FIGS. 21-22 show a magnetic fastener in accordance with another alternative embodiment of the present invention. Comparing with the above mentioned embodiments, the differences are described as follows. The main body 241 is made of materials that are not attracted by a magnet. The interface part 242 is a butt component connected to the end of the main body 241 by a method such as welding, bonding and interferential engagement. A moving component 257 is disposed between the interface part 242 and the elastic arms 243. The moving component 257 is spherical, and is received in the receiving space 244, which is made of materials that can be attracted by a magnet. An isolating component 258 is disposed between the moving component 257 and the butt component. The isolating component 258 is spherical or cylindrical, which is connected to the interface part 242 or to the moving component 257. The isolating component 258 may not be connected to the interface part 242 or the moving component 257. The isolating component 258 is made of materials that are not attracted by a magnet, so as to prevent the moving component 257 and the butt component from connecting together by magnetic force. While unlocking the first lock body and the second lock body, the interface part 242 can be attracted by the magnetic pole of one end of the first magnet 22 adjacent to the clasps, and the moving component 257 is attracted by the magnetic pole of the other end of the first magnet 22. The two magnetic attraction forces make the elastic arms 243 easier to stretch out of the through hole to achieve unlocking the first lock body and the second lock body. Meanwhile, as the first lock body and the second lock body are unlocked, the moving component 247 is tightly jammed inside the clasps 245, which can effectively prevent the clasps 245 from retracting into the through hole to be inconvenient for next locking. When the clasps 245 are required to enter the through hole again, an external force should be applied to make the moving component to move inward, thereby releasing the jammed position. Therefore, the moving component is pushed to move inward through the second lock body being inserted into the fastener body of the first lock body, thereby achieving locking.

In summary, the magnetic fastener of the present invention can be conveniently used by those who have poor vision and those who have poor finger function. Moreover, it is convenient to be locked or unlock without seeing with eyes.

Although the present invention has been described in detail with above said embodiments, but it is not to limit the scope of the invention. So, all the modifications and changes according to the characteristic and spirit of the present invention, are involved in the protected scope of the invention.

What is claimed is:

1. A magnetic fastener comprising first and second lock bodies engaged with each other; the first lock body including a first magnet and a fastener body; the first magnet being defined with a through hole extending through the two opposite end surfaces of the first magnet; the fastener body being movably received in the through hole; the fastener body including a main body, an interface part disposed at one end of the main body, and a plurality of elastic arms extending outward from the other end of the main body; the interface part passing through the through hole; a receiving space being defined between the elastic arms; the inner side of the free end of the elastic arms being respectively provided with a clasp; the second lock body including a second magnet and a hook body connected to the second magnet; the hook body being provided with a buckling part; the elastic arms of the fastener body being elastically deformed by inserting the buckling part into the receiving space of the fastener body as well as by the magnetic poles of the opposite two end surfaces of the first magnet and the second magnet attracting and abutting each other, whereby the clasps buckles with the buckling part for locking the first lock body and the second lock body together.

2. The magnetic fastener of claim 1, wherein the interface part and the main body are integrally formed; the interface part passes through the through hole, and the interface part is a connection hole defined at the end of the main body or is a butt component disposed at the end of the main body; or, the interface part is provided with an adjusting part that projects from the side surface of the main body along the radial direction of the main body, the interface part and the adjusting part are made of materials that are attractable by a magnet.

3. The magnetic fastener of claim 1, wherein the interface part and the main body are formed separately; the interface part comprises a hook part, a block part, and a connection part connected between the hook part and the block part; the block part and the connection part cooperatively form a T-shape; the hook part is ring-shaped; the main body of the fastener body is provided with a perforation; the block part of the interface part abuts the main body of the fastener body; the hook part abuts the end surface of the first magnet to prevent the interface part from being separated from the through hole.

4. The magnetic fastener of claim 1, wherein a collar is received in the through hole of the first magnet, and the collar is provided with a shoulder; protuberances are formed at the outside of the free end of the elastic arms, and the protuberances abut against the side wall of the collar to facilitate the clasps to buckle with the buckling part.

5. The magnetic fastener of claim 4, wherein the main body is provided with a locating part; the fastener body also comprises an elastic device that is sleevingly disposed at the main body with one end of the elastic device abutting against the shoulder of the collar, and the other end abutting against the locating part.

6. The magnetic fastener of claim 1, wherein the second magnet is defined with a mounting hole which extends through the two opposite end surfaces of the second magnet; the hook body also comprises a neck part connected to the buckling part, a mounting part connected to the neck part, and a butt part connected to the mounting part; the mounting part is received in the mounting hole; the hook body is fixedly connected to the second magnet; the buckling part is wider than the neck part along the radial direction of the neck part; the butt part is ring-shaped.

7. The magnetic fastener of claim 1, wherein a moving component is disposed between the interface part and the elastic arms; the moving component is spherical, is received in the receiving space, and is made of materials attractable by a magnet.

8. The magnetic fastener of claim 7, wherein an isolating component is disposed between the moving component and the interface part, and is made of materials that are not attracted by a magnet; the isolating component is spherical or cylindrical, and is connected to the interface part or to the moving component, or is not connected to the interface part or the moving component.

9. The magnetic fastener of claim 1, wherein the magnetic poles of the end surface of the first magnet opposite to the clasps and the end surface of the second magnet opposite to the buckling part are respectively S pole and N pole, or N pole and S pole; or, the opposite end surfaces of the first magnet and the second magnet are respectively provided with N pole and S pole.

10. The magnetic fastener of claim 1, wherein a first shell is covered on the first magnet, and a second shell is covered on the second magnet; or, a third shell is covered on the first magnet with one end of the third shell being defined with an opening that extends outward along the first magnet; the diameter of the opening is a slightly larger than the diameter of the second magnet; when the second magnet is at the locking status, the second magnet is inserted inside the third shell.

* * * * *